US005124306A

United States Patent [19]

Yamamoto et al.

[11] Patent Number: 5,124,306

[45] Date of Patent: Jun. 23, 1992

[54] HEAT-SENSITIVE RECORDING MATERIAL

[75] Inventors: Tooru Yamamoto, Anan; Yoshihiro Shimizu, Amagasaki; Toshio Kimura, Ashiya, all of Japan

[73] Assignee: Kanzaki Paper Manufacturing Co., Ltd., Tokyo, Japan

[21] Appl. No.: 540,623

[22] Filed: Jun. 19, 1990

[30] Foreign Application Priority Data

Jun. 27, 1989 [JP] Japan ..... 1-166287

[51] Int. Cl.[5] ..... B41M 5/40

[52] U.S. Cl. ..... 503/200; 503/207; 503/226

[58] Field of Search ..... 503/200, 226, 207

[56] References Cited

U.S. PATENT DOCUMENTS

| | | | |
|---|---|---|---|
| 4,246,312 | 1/1981 | Kosaka | 428/207 |
| 4,992,411 | 2/1991 | Ohkura | 503/200 |
| 4,997,806 | 3/1991 | Torii | 503/200 |

*Primary Examiner*—Pamela R. Schwartz

*Attorney, Agent, or Firm*—Wenderoth, Lind & Ponack

[57] ABSTRACT

A heat-sensitive recording material comprising a substrate, an intermediate layer disposed on said substrate and a heat sensitive recording layer disposed on said intermediate layer, characterized in that said intermediate layer contains a pigment of 80 cc/100 g or more in oil absorption as the main constituent and an alkaline pigment of 8 or more in PH value in an amount of 0.1 to 25% by weight on the total amount of the pigments contained in said intermediate layer.

4 Claims, No Drawings

HEAT-SENSITIVE RECORDING MATERIAL

FIELD OF THE INVENTION

The present invention relates to an improved heat-sensitive recording material having an intermediate layer containing a pigment of 80 cc/100 g or more in oil absorption as the main constituent and an alkaline pigment of 8 or more in pH value, which excels in reproduction of all images ranging from a low optical density region to a high optical density region, excels in brightness and has a good storage stability.

BACKGROUND OF THE INVENTION

There are known a number of heat-sensitive recording materials of the type that are so designed as to produce a record image when a color former and a color developer are brought into contact with each other by heat. Those heat-sensitive recording materials of this type are comparatively inexpensive and suitable for use in a compact recording machine, which is relatively easy in maintenance. In practice, they are used as a recording medium in facsimile systems, computer systems, heat-sensitive copying systems, and printers of other various instruments.

In recent years, various information instruments have been developed and they have been used in various sectors. For instance, as for the facsimile system, there have been commercialized various facsimile systems of improved high recording speed. There also have been commercialized various video-printers and bar code printers respectively capable of providing high-quality photography-like images. In this respect, there is an increased demand for providing an improved heat-sensitive recording material which is capable of instantly and precisely responding to a slight printing energy to record high quality clear images excelling in gradation and resolution corresponding to information signals transmitted. There is also another increased demand for the heat-sensitive recording material to be used in such instruments that it be so made as to enable it to provide desirable images with a sufficient recording density (optical density) in the entire density range from low density region to high density region, satisfactory gradation and resolution (reproduction of dots).

To meet the above demands, there have been proposed heat-sensitive recording materials having an intermediate layer of an oil absorptive inorganic pigment by Japanese Unexamined Patent Publications 59(1984)-155097 and 61(1986)-44683. There have been also proposed other heat-sensitive recording materials having an intermediate layer of multi-layered structure with an improved smoothness and heat-insulating property by Japanese Unexamined Patent Publications 61(1986)-11286 and 61(1986)-193880. However, any of these heat-sensitive recording materials are still problematic and not sufficient enough to desirably meet the above demands. That is, for the foregoing heat-sensitive recording materials having an intermediate layer containing an oil absorptive inorganic pigment, there are problems that when a high absorptive pigment such as silicon dioxide, calcined kaolin, etc. is used in the case of preparing the former heat-sensitive recording material, the specific surface area with respect to the pigment is increased to cause surface activation of silicic acid and as a result, particularly upon use of an acidic paper as the substrate, the brightness of the remaining white portion not having images thereon is decreased to cause a phenomenon called "background fogginess". Likewise, there are still similar problems also in the case of the foregoing heat-sensitive recording material having an intermediate layer of multi-layered structure. These problems are significant in the case where an acidic paper sheet is used as the substrate. Thus, there is an increased demand to provide an improved heat-sensitive recording material which is free of these problems and complies with the foregoing demands.

SUMMARY OF THE INVENTION

The main object of the present invention is to eliminate the foregoing problems found on the known heat-sensitive recording material, to comply with the foregoing demand and to provide an improved heat-sensitive recording material which is free of those problems and meets the foregoing demands.

Another object of the present invention is to provide an improved heat-sensitive recording material which excels in sensitivity and which is capable of instantly and precisely responding to a slight printing energy to record high quality clear images excelling in gradation and resolution (reproduction of dots) corresponding to information signals transmitted.

A further object of the present invention is to provide an improved heat-sensitive recording material which excels in sensitivity and brightness and which provides high quality clear images with a desirable record density (optical density), without accompaniment of background fogginess in the entire density range from low density region to high density region, and in satisfactory gradation and resolution (reproduction of dots).

A still further object of the present invention is to provide an improved heat-sensitive recording material having an excellent sensitivity and an excellent brightness which are stably maintained even upon storage for a long period of time and which stably provides high quality clear images with a desirable record density (optical density), without background fogginess and in satisfactory gradation and resolution (reproduction of dots), which images are stably maintained without being deteriorated even upon storage for a long period of time.

The present inventors have made extensive studies in order to solve the foregoing problems which are found on the known heat-sensitive recording material and in order to attain the above objects while focusing on the heat-sensitive recording material comprising a substrate, an intermediate layer and a heat-sensitive recording layer, said intermediate layer and said heat-sensitive recording layer being disposed in this order on said substrate.

As a result, it was found that when the intermediate layer is made such that contains a pigment of 80 cc/100 g or more in oil absorption as the main constituent and an alkaline pigment of 8 or more in pH value in an amount of 0.1 to 25% by weight on the basis of the total amount of the pigments contained in the intermediate layer, the foregoing objects can be effectively attained.

The present invention has been accomplished based on the above finding.

The present invention resides in an improved heat-sensitive recording material comprising a substrate, an intermediate layer formed on said substrate and a heat-sensitive recording layer formed on said intermediate layer, said intermediate layer containing a pigment of 80 cc/100 g or more in oil absorption as the main constituent and an alkaline pigment of 8 or more in pH value in an amount of 0.1 to 25% by weight on the basis of the total amount of the pigments contained therein, and said heat-sensitive recording layer containing a color former and a color developer capable of coloring said color former upon contact by heating.

The heat-sensitive recording material thus constituted according to the present invention excels in the brightness and in sensitivity, which quickly responds to a heat energy applied based on a signal of information transmitted in facsimile system, computer system or like other systems, and which provides high quality clear images with a desirable record density (optical density) without background fogginess and in satisfactory gradation and resolution (reproduction of dots), which images are stably maintained without being deteriorated even upon storage for a long period of time.

DETAILED DESCRIPTION OF THE INVENTION

As described above, the present invention relates to a heat-sensitive recording material comprising a substrate, an intermediate layer formed on said substrate and a heat-sensitive recording layer formed on said intermediate layer, characterized in that said intermediate layer contains a pigment of 80 cc/100 g or more in oil absorption (hereinafter referred to as "oil absorptive pigment") as the main constituent and an alkaline pigment of 8 or more in pH value in an amount of 0.1 to 25% by weight on the basis of the total amount of the pigments contained therein.

The foregoing objects of the present invention are effectively attained by the use of the specific intermediate layer containing a specific amount of an alkaline pigment together with an highly oil absorptive pigment as the main constituent.

As the alkaline pigment of 8 or more in pH value to be used in the present invention, there can be illustrated aluminum hydroxide, alumina, magnesium hydroxide, calcium hydroxide, precipitated calcium carbonate, ground calcium carbonate, magnesium carbonate, alkali modified silica, alkali modified clay, etc.

Among these alkaline pigments, magnesium carbonate is the most desirable since when it is used, the pH value of a coating composition to form the intermediate layer can be properly controlled to a specific value by the addition of a small amount of said magnesium carbonate and the bulkiness of the highly oil absorptive pigment contained in said coating composition as the main constituent can be maintained in a desirable state.

In the present invention, the incorporation of the foregoing alkaline pigment into the intermediate layer and its amount to be incorporated are basically important. That is, when the amount of the alkaline pigment contained in the intermediate layer is excessively small, there cannot be obtained the effects intended by the present invention. On the other hand, when the amount of the alkaline pigment contained in the intermediate layer is excessive, the resulting heat-sensitive recording material becomes such that the strength of the intermediate layer is not sufficient enough as desired and often provides such images as being defective in record density. In addition, there is often caused another problem in this case that the viscosity of the coating composition in order to form the intermediate layer becomes unavoidably high and because of this, it is difficult to form the intermediate layer in a desirable state.

In view of this, the amount of the alkaline pigment to be contained in the intermediate layer is preferably in the range of from 0.1 to 25% by weight, more preferably in the range of from 0.3 to 10% by weight, and most preferably, in the range of from 0.5 to 5% by weight, respectively on the basis of the total amount of the pigments contained in the intermediate layer.

The oil absorptive pigment to be contained as the main constituent in the intermediate layer of the heat-sensitive recording material according to the present invention contributes to making the resulting heat-sensitive recording material to effectively provide desirable images with a satisfactory record density.

As such oil absorptive pigment, there can be used any of the known pigments as long as it shows 80 cc/100 g or more in oil absorption under JIS K 5101 method Specific examples of the oil absorptive pigment are calcined kaolin, finely divided talc, silicon dioxide, polystyrene filler, amino resin filler, etc.

The coating composition to be applied onto a substrate for the formation of the intermediate layer in the present invention contains a binder in addition to the foregoing highly oil absorptive pigment and the foregoing alkaline pigment.

Usable as the binder are, for example, water-soluble polymers such as starch, casein, polyvinyl alcohol, methyl cellulose, carboxyethyl cellulose, hydroxyethyl cellulose, polyacrylate, and various synthetic resin emulsions such as styrene-butadiene copolymer emulsion, styrene-acrylic acid copolymer emulsion, acrylonitrile-butadiene copolymer emulsion, colloidal silica particle composite styrene-acrylic ester copolymer emulsion, acrylic acid copolymer emulsion, etc.

It is possible to use one or more of these materials as the binder to be contained in the foregoing coating composition to form the intermediate layer.

As for the amount of the foregoing binder to be contained in the foregoing coating composition to form the intermediate layer, it is desired to be in the range of from 5 to 30 parts by weight versus 100 parts by weight of the pigment in terms of the sum of the pigments not only in the viewpoint of providing the intermediate layer with a desirable adhesion to the substrate but also in the viewpoint of providing the heat-sensitive recording layer with a desirable sensitivity. When the amount of the foregoing binder contained in the coating composition exceeds said upper limit of 30 parts by weight, the void of the intermediate layer formed is undesirably decreased to cause reduction in its heat maintenance. In this case, there often occur problems that the heat-sensitive recording layer to be formed on such intermediate layer does not exhibit a sufficient sensitivity and the thermal head of the recording system is contaminated with foreign matters. On the other hand, when the amount of the foregoing binder contained in the coating composition is less than the lower limit of 5 parts by weight, there often occur problems that the adhesion properties of the pigment particles are diminished and because of this, powders are generated upon cutting the heat-sensitive recording material.

In the case of preparing a coating composition for the formation of the intermediate layer by using a binder having carboxyl group in addition to the foregoing highly oil absorptive pigment as the main constituent and the foregoing alkaline pigment in a specific amount, there is sometimes such an occasion that chemical reactions such as salting-out to cause undesirable rise in the viscosity of the resulting composition and undesirable reduction in the effects of the binder.

However, this problem can be effectively prevented from occurring by the use of an appropriate dispersant For instance, in the case of using sodium polyacrylate as the dispersant, said salting-out reaction is effectively prevented from occurring and the pigments are dispersed in a desired state to afford a desirable coating composition for the formation of the intermediate layer which excels in the coating property.

In view of this, it is one of the preferred embodiments of the present invention to incorporate a dispersant comprising sodium polyacrylate into the intermediate layer. As for the amount of said sodium polyacrylate, it is desired to be in the range of from 0.01 to 5% by weight versus the total amount of the pigments.

The coating composition for the formation of the intermediate layer may be properly prepared by dispersing or dissolving the foregoing highly oil absorptive pigment, the foregoing alkaline pigment, the foregoing binder, and if necessary, the foregoing dispersant into an appropriate solvent such as water individually or altogether using a mixer or grinder such as ball mill, attritor and sand mill.

The coating composition for the formation of the intermediate layer may contain one or more of known auxiliaries.

The intermediate layer of the heat-sensitive recording material according to the present invention is formed by applying the foregoing coating composition onto the surface of a substrate in a predetermined amount to form a liquid coat and drying the liquid coat.

The application of the coating composition onto the surface of the substrate upon forming the intermediate layer may be carried out by means of a conventional off-machine coating device or on-machine coating machine equipped with a coater such as air knife coater, pure blade coater, rod blade coater, bill blade coater, roll coater and size press.

The amount of the coating composition to be applied onto the surface of the substrate in order to form the intermediate layer of the heat-sensitive recording material according to the present invention is not particularly limited. It should be properly determined depending upon the characteristics desired for the heat-sensitive recording material to be obtained. However, in general, it is preferably in the range of from 2 to 35 $g/m^2$ on the basis of dry weight which makes the thickness of the intermediate layer to be in the range of from 3 to 40 $\mu m$.

The intermediate layer of the heat-sensitive recording material according to the present invention is not always limited to a single layer. It is possible for the intermediate layer to be of a multi-layered structure depending upon the necessity to do so.

In this case, the multi-layered intermediate layer may be formed by repeating the foregoing procedures of forming the intermediate layer to thereby stack two or more thin layers.

Now, in the heat-sensitive recording material according to the present invention, the heat-sensitive recording layer is disposed on the foregoing intermediate layer. As described before, the heat sensitive recording layer of the heat-sensitive recording material according to the present invention contains at least a color former and a color developer capable of coloring said color former upon contact by heating. The heat-sensitive recording layer may be formed by providing a coating dispersion containing the color former and the color developer and applying the coating dispersion onto the surface of the foregoing intermediate layer in the same manner as in the case of forming the intermediate layer.

As the color former, any of known color formers can be used as long as desirable color development is caused when it is contacted with the developer used by heating. As the color developer, any of known color developers can be used as long as the above requirement is fulfilled.

As the combination of the color former and the color developer, there can be used the combination of a colorless or light-colored basic dye and an organic or inorganic acid substance which produces a color upon contact with said basic dye; the combination of a metal salt of a higher fatty acid such as ferric stearate and a phenolic acid such as gallic acid; the combination of a diazonium compound, a coupler and a basic substance, and the like.

Of these combinations, the combination of a colorless or light-colored basic dye and an organic acid substance or an inorganic acid substance is the most desirable since the foregoing specific intermediate layer markedly exhibits its functions in combination with the heat-sensitive recording layer containing a colorless or light-colored basic dye and an organic or inorganic acidic substance which produces a color upon contact with said basic dye.

Usable as the colorless or light-colored basic dye are, for example, triarylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3-3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, and 3-p-dimethylaminophenyl-3-(1-methylpyrrol-3-yl)-6-dimethylaminophthalide; diphenylmethane dyes such as 4,4'-bis-dimethylaminobenz-hydrylbenzylether, N-halophenylleucoauramine, N-2,4,5-trichlorophenyl-leucoauramine; thiazine dyes such as benzoyl-leucomethyleneblue and p-nitrobenzoyl-leucomethyleneblue; spiro dyes such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, and 3-propyl-spiro-dibenzopyran; lactam dyes such as rhodamine-B anilino-lactam, rhodamine (p-nitro-anilino)lactam, and rhodamine-(o-chloroanilino)-lactam; and fluoran dyes such as 3-dimethyl-amino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3 diethylamino-6, 7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenyl-aminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-dibutylamino-7-o-chlorophenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-pyperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chloro-phenyamino)fluoran, 3-pyrrolidino-6-methyl-7-p-butylphenyl-aminofluoran, 3-N-methyl-N-tetrahydrofurfurylamino-6-methyl-7-anilinofluoran, and 3-N-ethyl-N-tetrahydrofurfurylamino-6-methyl-7-anilinofluoran.

These basic dyes may be used alone or in combination of two or more of them.

Usable as the inorganic acidic substance as the developer which produces a color upon contact with any of the foregoing basic dyes are, for example, those substances as mentioned below.

That is, activated clay, acidic clay, attapulgite, bentonite, colloidal silica, aluminum silicate, etc.

Likewise, usable as the organic acidic substance as the developer which produces a color upon contact with any of the above-mentioned basic dyes are those substances as mentioned below.

That is, phenolic compounds such as 4-tert-butylphenol, 4-hydroxyphenoxide, α-naphthol, β-naphthol, 4-hydroxyacetophenol, 4-tert-octylcatechol, 2,2'-dihydroxydiphenol, 2,2'-methylene-bis(4-methyl-6-tert-isobutylphenol), 4,4'-isopropylidene-bis(2-tert-butylphenol), 4,4'-secbutylidene diphenol, 4-phenylphenol, 4,4'-isopropylidenediphenol, 2,2'-methylene-bis(4-chlorophenol), hydroquinone, 4,4'-cyclohexylidene diphenol, benzyl 4-hydroxybenzoate, dimethyl 4-hydroxyphthalate, hydroquinonemonobenzyl ether, 4-hydroxy-4'-isopropyloxydiphenylsulfone, 3',4'-tetramethylene-4-hydroxydiphenylsulfone, 4,4'-(1,3-dimethylbutylidene)bisphenol, 4,4'-(1-phenylethylidene) bisphenol, 4,4'-(p-phenylenediisopropylidene)diphenol, 4,4'-(m-phenylenediisopropylidene)diphenol, novolak type phenolic resin and phenol polymer: aromatic carboxylic acids such as benzoic acid, p-tert-butyl benzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzl) salicylic acid, 3-phenyl-5(α,α-dimethylbenzyl)salicylic acid, and 3,5-di-α-methylbenzylsalicylic acid; and salts of such phenolic compounds or aromatic carboxylic acids with polyvalent metals such as zinc, magnesium, aluminum, calcium, titanium, manganese, tin, and nickel.

These substances usable as the color developer may be used alone or in combination of two or more of them.

For the preparation of the heat-sensitive recording layer of the heat-sensitive recording material according to the present invention, the proportions of the color former and the color developer to be incorporated into said recording layer are properly determined depending upon the kinds of these materials to be selectively used and are not particularly limited.

For example, when the combination of a colorless or light-colored basic dye and an inorganic or organic acidic substance is used, preferably 1 to 10 parts by weight, more preferably 1.5 to 7 parts by weight, of the acidic substance is used per a part by weight of the basic dye.

These two kinds of materials are formulated into a coating dispersion for the formation of the heat-sensitive recording layer generally with the use of water as a dispersion medium and a stirring or pulverizing device, such as a ball mill, attritor or sand mill, by dispersing the two kinds of materials into said dispersion medium at the same time or separately.

Usually the coating dispersion is incorporated therein a binder preferably in an amount of 10 to 40% by weight or more preferably in an amount of 15 to 30% by weight, based on the total solids content of the dispersion.

Usable as such binder are, for example, starch, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, natural gum emulsion, styrene-butadiene copolymer emulsion, acrylonitrile-butadiene copolymer emulsion, methylmethacrylate-butadiene copolymer emulsion, polychloroprene emulsion, vinyl acetate emulsion, ethylene-vinyl acetate copolymer emulsion.

Various auxiliary agents can be further admixed with the coating dispersion for the formation of the heat-sensitive recording layer Examples of such auxiliary agent are dispersants such as sodium dioctylsulfosuccinate, sodium dodecylbenzenesulfonate, laurylalchol sulfonic acid ester sodium salt, alginic acid metallic salts and fatty acid metallic salts; ultraviolet absorbers of the benzophenone, triazole or like type; defoaming agents; fluorescent dyes; coloring dyes, etc.

When desired for improving the sensitivity of the heat-sensitive recording layer, a sensitizer can be admixed with the coating dispersion. Examples of such sensitizer are stearic acid amid, stearic acid methylenebisamide, oleic acid amide, palmitic acid amide, coconut fatty acid amide, etc.

Further, when desired, other additives can be incorporated into the coating dispersion for the formation of the heat-sensitive recording layer.

Examples of such additive are lubricants such as zinc stearate, calcium stearate, polyethylene wax, carnauba wax, paraffin wax and ester wax; inorganic pigments such as calcium carbonate, zinc oxide, aluminum oxide, titanium dioxide, silicon dioxide, aluminum hydroxide, barium sulfate, zinc sulfate, talc, kaolin, clay, calcined clay and colloidal silica; organic pigments such as styrene microball, nylon powder, polyethylene powder, urea.formalin resin filler and starch; hindered phenols such as dibenzylterephthalate, 1,2-di(3-methylphenoxy)ethane, 1,2-diphenoxy ethane, 4,4'-ethylenedioxy-bisbenzoic acid diphenyl methyl ester, 1,1,3-tris(2-methyl-4-hydroxy-5-tert-butylphenyl) butane, 2,2'-methylenebis(4-methyl-6-tert-butylphenol), and 4,4'-butylidenebis(6-tert-butyl-3-methylphenol); and known heat-fusible materials.

When an inorganic or organic pigment is incorporated into the heat-sensitive recording layer, it is desired to use such inorganic or organic pigment having a small particle size of 2 μm or less in the average particle size.

The heat-sensitive recording layer of the heat-sensitive recording material according to the present invention may be properly formed on the foregoing intermediate layer by means of a conventional coating device equipped with air-knife coater, pure blade coater, rod blade coater, short dwell time coater, etc wherein the coating dispersion for the formation of said heat-sensitive recording layer is applied onto the foregoing intermediate layer previously formed on a substrate to form a liquid coat which is followed by drying.

The amount of the coating dispersion to be applied onto the surface of the intermediate layer in order to form the heat-sensitive recording layer is not particularly limited. It should be properly determined upon the related situation. However, in general, it is preferably in the range of from 2to 12 g/m$^2$, or more preferably in the range of from 3 to 10 g/m$^2$, on the basis of dry weight.

As for the substrate of the heat-sensitive recording material according to the present invention, there is not a particular limitation. There can be used papers prepared by using a Fourdrinier paper machine, twin wire paper machine or Yankee paper machine, one-side glazed paper, a double sides glazed paper, a cast coated paper, a No.1-No.5 grade coated paper, a synthetic paper, polymer films, and composite sheets of these papers and films.

In a preferred embodiment with respect to the substrate, a paper prepared under the paper-making condition at a pH value in the range of from 6.0 to 9.0 is the most desirable. That is, when this paper is used as the substrate, the brightness of the resulting heat-sensitive recording material becomes significant due to the synergism with the foregoing specific intermediate layer disposed thereon and said excellent brightness is maintained without undesirably deteriorated even upon storage for a long period of time.

In the present invention, it is possible for the intermediate layer or the heat-sensitive layer as formed after being dried to be smoothed, for example, by way of supercalendering.

Further, it is possible to dispose a protective layer on the heat-sensitive recording layer. Further in addition, it is possible for the substrate to have a coated layer on its rear side face.

The heat-sensitive recording material thus provided according to the present invention excels in the brightness and sensitivity, and which quickly responds to a heat energy applied based on a signal of information transmitted in facsimile system, computer system or like other systems, and which stably provides high quality clear images with a desirable record density (optical density) without background fogginess and in satisfactory gradation and resolution (reproduction of dots), which images are stably maintained without being deteriorated even upon storage for a long period of time.

PREFERRED EMBODIMENTS OF THE INVENTION

The advantages of present invention are now described in more detail by reference to the following Examples and Comparative Examples, which are provided here for illustrative purposes only, and are not intended to limit the scope of the present invention.

Unless otherwise indicated, parts and % signify parts by weight and % by weight respectively.

EXAMPLE 1

1. Preparation of a Sheet to be the Substrate

A paper raw material was obtained by adding to a pulp slurry composed of 10 parts of a NBKP and 90 parts of a LBKP respectively of Canadian Standard Freeness 450 CC, 8 parts of talc, 1.5 parts of rosin size and 3 parts of aluminum sulfate respectively versus the amount of said pulp. The paper raw material was subjected to the paper-making process under acidic condition in the Fourdrinier paper machine to thereby obtain a paper of 50 g/m$^2$. The resultant paper was then subjected to surface-sizing with the use of oxidized starch by a size press to thereby obtain a sheet sized with said oxidized starch in an amount of 1.0 g/m$^2$ on the dry weight basis.

2. Preparation of a Coating Composition for the Formation of an Intermediate Layer 95 parts of calcined kaolin (oil absorption: 110 cc/100 g), 5 parts of alkali modified silica (pH: 11), 15 parts of styrene-butadiene copolymer latex (trade name: DOW-1571, solid content: 48%, product by Asahi Chemical Industry Co., Ltd.), and 2 parts of an aqueous solution of polyvinyl alcohol were dispersed into water to obtain a coating composition for the formation of an intermediate layer with a solid content of 35%.

3. Preparation of a Coating Composition for the Formation of a Heat-Sensitive Recording Layer

(1) Preparation of a Composition A

A mixture composed of 10 parts of 3-(N-cyclohexyl-N-methylamino)-6-methyl-7-phenylaminofluoran, 20 parts of 1,2-di(3-methylphenoxy)ethane, 15 parts of a 5% aqueous solution of methylcellulose, and 80 parts of water was pulverized by a sand mill to mean particle size of 3 μm, to thereby obtain a composition A.

(2) Preparation of a Composition B

A mixture composed of 30 parts of 4,4'-isopropylidenediphenol, 30 parts of a 5% aqueous solution of methylcellulose and 70 parts of water was pulverized by a sand mill to mean particle size of 2 μm, to thereby obtain a composition B.

(3) Preparation of a Coating Composition for the Formation of a Heat-Sensitive Recording Layer 125 parts of the composition A, 130 parts of the composition B, 30 parts of silicon dioxide (oil absorption: 180 cc/100 g), 150 parts of a 20% aqueous solution of oxidized starch and 55 parts of water were mixed together and agitated to thereby obtain a coating composition for the formation of a heat-sensitive recording layer.

4. Formation of an Intermediate Layer and a Heat-Sensitive Recording Layer

The coating composition obtained in the above step 2 was applied onto the surface of the sheet obtained in the above step 1 in an amount to be 8 g/m$^2$ (13 μm in thickness) after being dried by means of a rod blade coater to form a liquid coat on the surface of said sheet, which was followed by air-drying, to thereby form an intermediate layer of 13 μm in thickness on the surface of said sheet.

Then, the coating composition obtained in the above step 3 was applied onto the surface of the previously formed intermediate layer in an amount to be 5 g/m$^2$ after being dried by means of a rod blade coater to form a liquid coat on the surface of the intermediate layer, which was followed by air-drying and then supercalendering, to thereby form the heat-sensitive recording layer on the intermediate layer.

Thus, there was obtained a heat-sensitive recording sheet.

Evaluation

The resultant heat-sensitive recording sheet was evaluated with respect to record density (optical density), brightness, background fogginess, and cutting suitability by the following evaluation methods. The evaluated results obtained were as shown in Table 1.

Record Density (Optical Density)

The heat-sensitive recording sheet was subjected to a commercially available facsimile device UF-60 (product by Matsushita Graphic Communication Systems, Inc.) to record an image thereon.

The record density (optical density) of the resultant image was measured using a RD-100R Macbeth densitometer (product by Macbeth Co., Ltd.) wherein an amber filter was used.

Brightness

The brightness of the heat-sensitive recording sheet was measured using a Hunter brightness meter (product by Toyoseiki KABUSHIKI KAISHA).

Background Fogginess

The heat-sensitive recording sheet was stored in an air-conditioning equipment under the conditions of 40° C. and 5% RH for 48 hours, and thereafter its brightness was measured.

Cutting Suitability

The heat-sensitive recording sheet with images recorded was cut at the portion having recorded images and at other portion (white portion) having no image by a cutter, and the state of generation of edge dust and the state of occurrence peeling-off of the heat-sensitive recording layer were observed.

The evaluation for this item was made under the following standard:

Excellent: no edge dust was generated and the heat-sensitive recording layer was not peeled off at all.

Good: no edge dust was generated but peeling-off was slightly observed for the heat-sensitive recording layer.

Not acceptable: significant generation of edge dust was observed and the heat-sensitive recording layer was distinguishably peeled off.

TABLE 1

| | Record Density | Brightness | Background Fogginess | Cutting Suitability |
|---|---|---|---|---|
| Example 1 | 1.34 | 84.0 | 80.6 | Good |

EXAMPLES 2 TO 3 AND COMPARATIVE EXAMPLES 1 TO 3

EXAMPLE 2

The procedures of Example 1 were repeated, except that the coating composition for the formation of the intermediate layer was replaced by a coating composition (a) which was prepared as follows, to thereby obtain a heat-sensitive recording sheet.

Preparation of the coating composition (a)

97 parts of calcined kaolin (oil absorption: 110 cc/100 g), 3 parts of magnesium carbonate (pH: 8.2), 11 parts of styrene-butadiene copolymer latex (trade name: DOW-1571, solid content 48%, product by Asahi Chemical Industry Co., Ltd.), and 2 parts of an aqueous solution of polyvinyl alcohol were dispersed into water to obtain a coating composition with a solid content of 35%.

The resultant heat-sensitive recording sheet was evaluated in the same manner as in Example 1. The evaluated results were shown in Table 2.

EXAMPLE 3

The procedures of Example 2 were repeated, except that the amount of the calcined kaolin and that of the magnesium carbonate to be used for the coating composition (a) were changed to 99.5 parts and 0.5 parts respectively, to thereby obtain a heat-sensitive recording sheet.

The resultant heat-sensitive recording sheet was evaluated in the same manner as in Example 1. The evaluated results were shown in Table 2.

COMPARATIVE EXAMPLE 1

The procedures of Example 2 were repeated, except that the amount of the calcined kaolin and that of the magnesium carbonate to be used for the coating composition (a) were changed to 100 parts and zero part respectively, to thereby obtain a comparative heat-sensitive recording sheet.

The resultant heat-sensitive recording sheet was evaluated in the same manner as in Example 1. The evaluated results were shown in Table 2.

COMPARATIVE EXAMPLE 2

The procedures of Example 2 were repeated, except that 10 parts of magnesium carbonate was incorporated into the coating composition for the formation of the heat-sensitive recording layer but no magnesium carbonate was incorporated into the coating composition for the formation of the intermediate layer, to thereby obtain a comparative heat-sensitive recording sheet.

The resultant heat-sensitive recording sheet was evaluated in the same manner as in Example 1.

The evaluated results were shown in Table 2.

COMPARATIVE EXAMPLE 3

The procedures of Example 2 were repeated, except that the amount of the calcined kaolin and that of the magnesium carbonate to be used for the coating composition (a) were changed to 70 parts and 30 parts respectively, to thereby obtain a comparative heat-sensitive recording sheet.

The resultant heat-sensitive recording sheet was evaluated in the same manner as in Example 1. The evaluated results were shown in Table 2.

TABLE 2

| | Record Density | Brightness | Background Fogginess | Cutting Suitability |
|---|---|---|---|---|
| Example 2 | 1.36 | 84.3 | 81.5 | Good |
| Example 3 | 1.35 | 84.2 | 81.2 | Good |
| Comparative Example 1 | 1.34 | 84.0 | 79.2 | Good |
| Comparative Example 2 | 1.18 | 83.9 | 79.3 | Good |
| Comparative Example 3 | 1.15 | 84.3 | 81.8 | Not acceptable |

From the results shown in Table 2, it has been recognized that any of the heat-sensitive recording sheets respectively having an intermediate layer containing a predetermined amount of magnesium carbonate which were obtained in Examples 2 and 3 is not largely improved in comparison with the comparative heat-sensitive recording sheet obtained in Comparative Example 1 having the intermediate layer not containing magnesium carbonate as far as the record density and brightness are concerned but any of the formers is surpassing the latter by 2.0% or more with respect to the background fogginess and sufficiently provides the effects intended by the present invention.

As for the comparative heat-sensitive recording sheet obtained in Comparative Example 2 which has the heat-sensitive recording layer containing magnesium carbonate which is not contained in the intermediate layer, it has been recognized that said comparative heat-sensitive recording sheet is apparently inferior to any of the heat-sensitive recording sheets obtained in Examples 2 and 3 with respect to the record density and the background fogginess.

As for the comparative heat-sensitive recording sheet obtained in Comparative Example 3 which has the intermediate layer containing an excessive amount of magnesium carbonate, it has been recognized that said comparative heat-sensitive recording sheet is apparently inferior to any of the heat-sensitive recording sheets obtained in Examples 2 and 3 with respect to the record density and in addition to this, the intermediate layer of said comparative heat-sensitive recording sheet is defective in its strength and said comparative heat-sensitive recording sheet does not have an acceptable cutting suitability since it generates a distinguishable amount of edge dust upon cutting.

EXAMPLES 4 to 7

EXAMPLE 4

The procedures of Example 1 were repeated, except that the coating composition for the formation of the intermediate layer was replaced by a coating composition (b) which was prepared as follows, to thereby obtain a heat-sensitive recording sheet.

Preparation of the Coating Composition (b)

90 parts of silicon dioxide (oil absorption: 180 cc/100 g), 10 parts of magnesium carbonate (pH: 8.2), 15 parts of styrene-butadiene copolymer latex (trade name: DOW-1571, solid content: 48%, product by Asahi Chemical Industry Co., Ltd.), and 2 parts of an aqueous solution of polyvinyl alcohol were dispersed into water to obtain a coating composition with a solid content of 35%.

The resultant heat-sensitive recording sheet was evaluated in the same manner as in Example 1.

The evaluated results were shown in Table 3.

EXAMPLE 5

The procedures of Example 2 were repeated, except that 0.3 parts of sodium polyacrylate was additionally incorporated into the coating composition (a), to thereby obtain a heat-sensitive recording sheet.

The resultant heat-sensitive recording sheet was evaluated in the same manner as in Example 1.

The evaluated results were shown in Table 3.

EXAMPLE 6

The procedures of Example 4 were repeated, except that 2 parts of sodium polyacrylate was additionally incorporated into the coating composition (b), to thereby obtain a heat-sensitive recording sheet.

The resultant heat-sensitive recording sheet was evaluated in the same manner as in Example 1.

The evaluated results were shown in Table 3.

EXAMPLE 7

The procedures of Example 5 were repeated, except that the coating composition for the formation of the intermediate layer was applied onto the surface of the sheet prepared in the same manner as in Example 1 in an amount to be 3 g/m$^2$ after being dried by means of a blade coater to form a first intermediate layer and said coating composition was again applied onto the surface of the previously formed first intermediate layer in an amount to be 5 g/m$^2$ after being dried in the same manner in the former case to stack a second intermediate layer whereby forming a 12 $\mu$m thick intermediate layer comprising two layers, to thereby obtain a heat-sensitive recording sheet.

The resultant heat-sensitive recording sheet was evaluated in the same manner as in Example 1.

The evaluated results were shown in Table 3.

TABLE 3

| | Record Density | Brightness | Background Fogginess | Cutting Suitability |
|---|---|---|---|---|
| Example 4 | 1.39 | 84.8 | 81.8 | Good |
| Example 5 | 1.38 | 84.3 | 81.3 | Excellent |
| Example 6 | 1.40 | 84.4 | 81.3 | Excellent |
| Example 7 | 1.42 | 84.8 | 81.8 | Good |

From the results shown in Table 3, it has been recognized that the incorporation of sodium polyacrylate into the intermediate layer of the heat-sensitive recording sheet according to the present invention provides a marked improvement in the cutting suitability for the heat-sensitive recording sheet as apparent from the results obtained in Examples 5 and 6. It has been also recognized that as apparent from the results obtained in Example 7, when the intermediate layer is constituted by a plurality of constituent layers being stacked, the resulting heat-sensitive recording sheet becomes excellent in the record density, brightness and background fogginess.

EXAMPLE 8 AND COMPARATIVE EXAMPLE 4

EXAMPLE 8

The procedures of Example 2 were repeated, except that as the substrate, there was used a sheet which was prepared as follows, to thereby obtain a heat-sensitive recording sheet.

Preparation of Said Sheet:

A paper raw material was obtained by adding, to a pulp slurry composed of 10 parts of a NBKP and 90 parts of a LBKP respectively of Canadian Standard Freeness 450 cc, 8 parts of calcium carbonate, 0.07 parts of a sizing agent of alkylketenic dimer, 0.5 parts of a cationic modified starch and 0.02 parts of a yield improving agent respectively versus the amount of said pulp. The paper raw material was subjected to the paper-making process under the condition of pH 7.6 in the Fourdrinier paper machine to thereby obtain a paper of 50 g/m$^2$. The resultant paper was then subjected to surface-sizing with the use of oxidized starch by a size press to thereby obtain a sheet sized with said oxidized starch in an amount of 1.0 g/m$^2$ on the dry weight basis.

The resultant heat-sensitive recording sheet was evaluated in the same manner as in Example 1.

The evaluated results were shown in Table 4.

COMPARATIVE EXAMPLE 4

The procedures of Example 8 were repeated, except that the amount of the calcined kaolin and that of the magnesium carbonate to be used for the coating composition (a) were changed to 100 parts and zero part respectively, to thereby obtain a comparative heat-sensitive recording sheet.

The resultant heat-sensitive recording sheet was evaluated in the same manner as in Example 1.

The evaluated results were shown in Table 4.

TABLE 4

| | Record Density | Brightness | Background Fogginess | Cutting Suitability |
|---|---|---|---|---|
| Example 8 | 1.38 | 84.6 | 82.2 | Good |
| Comparative Example 4 | 1.35 | 84.0 | 80.4 | Good |

From the results shown in Table 4, the following facts have been recognized. That is, the heat-sensitive recording sheet according to the present invention (obtained in Example 8) which has a neutralized paper sheet as the substrate and the specific intermediate layer containing a prescribed amount of magnesium carbonate is satisfactory with the record density, brightness and cutting suitability, and excels in the background fogginess. On the other hand, the comparative heat-sensitive recording sheet obtained in Comparative Example 4 which has a neutralized paper sheet as the substrate and the intermediate layer not containing magnesium carbonate has a certain improvement in the background fogginess due to the use of said paper sheet but it does not provides distinguishable good effects in view of the record density, brightness and cutting suitability as in the case of the heat-sensitive recording sheet obtained in Example 8.

What we claim is:

1. A heat-sensitive recording material comprising a substrate, an intermediate layer disposed on said substrate and a heat-sensitive recording layer disposed on said intermediate layer, wherein said intermediate layer consisting essentially of a pigment of 80 cc/100 g or more in oil absorption as the main constituent and an alkaline pigment comprising magnesium carbonate of 8 or more in pH value in an amount of 0.1 to 25% by weight based on the total amount of the pigments contained in said intermediate layer.

2. A heat-sensitive recording material according to claim 1, wherein the substrate is a neutralized paper sheet.

3. A heat-sensitive recording material according to claim 2, wherein the intermediate layer further contains sodium polyacrylate in an amount of 0.01 to 5% by weight on the basis of the total amount of the pigments contained in the intermediate layer.

4. A heat-sensitive recording material according to claim 1, wherein the intermediate layer further contains sodium polyacrylate in an amount of 0.01 to 5% by weight on the basis of the total amount of the pigments contained in the intermediate layer.

* * * * *